US007776401B2

(12) United States Patent
Sauer et al.

(10) Patent No.: US 7,776,401 B2
(45) Date of Patent: Aug. 17, 2010

(54) METHOD FOR TREATING FABRIC WITH VISCOUS LIQUID POLYMERS

(75) Inventors: Bryan Benedict Sauer, Boothwyn, PA (US); Kalika Ranjan Samant, Hockessin, DE (US); Joseph D. Trentacosta, Wilmington, DE (US); Minshon J. Chiou, Chesterfield, VA (US); James C. Davis, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 971 days.

(21) Appl. No.: 11/158,956

(22) Filed: Jun. 21, 2005

(65) Prior Publication Data

US 2007/0172594 A1 Jul. 26, 2007

(51) Int. Cl.
*F41H 5/08* (2006.01)
*F42B 39/08* (2006.01)
*B05D 3/02* (2006.01)

(52) U.S. Cl. ..... 427/389.9; 89/36.01; 89/36.05

(58) Field of Classification Search ..... 427/389.9
See application file for complete search history.

(56) References Cited

U.S. PATENT DOCUMENTS 3,649,426 A 3/1972 Gates, Jr.
4,134,726 A * 1/1979 Rye et al. ..... 8/139.1
4,623,574 A * 11/1986 Harpell et al. ..... 428/113
5,349,893 A * 9/1994 Dunn ..... 89/36.05
5,354,605 A 10/1994 Lin et al.
6,433,133 B1 * 8/2002 Coe ..... 528/481
6,846,758 B2 * 1/2005 Bhatnagar et al. ..... 442/135
2003/0199215 A1 * 10/2003 Bhatnagar et al. ..... 442/135
2006/0252325 A1 * 11/2006 Matsumura et al. ..... 442/123

FOREIGN PATENT DOCUMENTS

WO WO 00/46303 8/2000
WO WO 2004/074761 A1 9/2004

OTHER PUBLICATIONS

Mallick, "Fiber-reinforced Composites: Materials, Manufacturing, and Design", 1993, CRC Press, p. 80.*
Fung, Walter, Coated and Laminated Textiles, 2002 (Knovel release: Dec. 3, 2004), Woodhead Publishing, p. 102-104.*
Knovel solvent data for Dichloromethane.*
Halle, Richard W. "New Ethylene-Methyl Acrylate Copolymers for multiplayer Flexible Packaging Application," 1989, Journal of Plastic Film and Sheeting, vol. 5, Abstract.*
Briscoe, B. J., Motamedi, F., "Role of interfacial friction and lubrication in yarn and fabric mechanics", Textile Research Journal 1990 6(12), 697.
Briscoe, B. J., Motamedi, F., "The ballistic impact characteristics of aramid fabrics: the influence of interface friction", Wear 1992 158(1-2), 229.
Lee, Y.S. et al., N.J. Advanced Body Armor Utilizing Shear Thickening Fluids, 23rd Army Science Conference, 2002.

* cited by examiner

*Primary Examiner*—Timothy H Meeks
*Assistant Examiner*—Mandy C Louie

(57) ABSTRACT

A process of treating a woven fabric by applying to the fabric a viscous polymer in a 5 to 40 wt % solution with a solvent, wherein the polymer has a $T_g$ in the range of about minus 40 to about 0° C. and a zero shear melt viscosity of about $2\times10^6$ to about $10^{13}$ poise when measured at 20° C. and then evaporating the solvent such that the polymer only partially penetrates the fabric and penetrates to in and between fiber bundles before the polymer solidifies.

14 Claims, No Drawings

METHOD FOR TREATING FABRIC WITH VISCOUS LIQUID POLYMERS

BACKGROUND OF THE INVENTION

1. Field of the Invention

This invention is directed to treating fabrics for use in protective apparel with viscous polymer solutions.

2. Description of Related Art

Current soft body armors made from woven fabrics require high area weight density, partly in order to achieve less than 44 mm Back Face Deformation (BFD as required by NIJ standard 0101.04 Revision A). BFD is an indicator of blunt trauma, the lower the BFD, the better the protection from blunt trauma. Although many soft body armor constructions can adequately stop ballistic projectiles, the shock associated with blunt trauma can still cause substantial injury or death. Because woven fabrics and the related soft body armor made therefrom typically exhibit high BFD values, higher basis weight are often required for compliance with NIJ standard 0101.04 rev. A. For example, current 100% woven Kevlar® vests weigh more than 1 pound per square foot (psf) for level II protection under the NIJ standard. For example, conventional fabrics are often impregnated with solid adhesives, such as polyethylene laminated into the fabric in film form.

Briscoe, B. J., Motamedi, F., "Role of interfacial friction and lubrication in yarn and fabric mechanics", *TextileResearch Journal* 1990 6(12), 697 and Briscoe, B. J., Motamedi, F. "The ballistic impact characteristics of aramid fabrics: the influence of interface friction", *Wear* 1992 158(1-2), 229 both describe medium viscosity polymer fluids that were impregnated into fabrics. Additives had a low $T_g$ of −115° C. They found a lubrication effect as expected.

International application (WO 2004/074761 A1) discloses visco-elastic polymer fluids that were solvent impregnated into ballistic fabrics and other related fiber containing ballistic sheets. Preferred range of glass transition temperature ($T_g$) is −128° C. to −40° C. Low viscosities of 0.25 Pa s to $2.5\times10^4$ Pa s were considered.

WO 00/46303 and U.S. Pat. No. 3,649,426 describe polyaramid fabrics with shear-thickening particle suspensions in pouches or in back of polyaramid panels.

Lee, Y. S. et al. (N.J. Advanced Body Armor Utilizing Shear Thickening Fluids, 23$^{rd}$ Army Science Conference, 2002) consider shear-thickening suspensions of particles in conjunction with ballistic fibers.

U.S. Pat. Nos. 5,354,605 and 4,623,574 used low $T_g$, high molecular weight elastomers as adhesive matrix materials for fiber layers. These provided flexibility in unidirectional ballistic layers.

Applying low levels, less than about 3%, of such solid adhesives from the melt is not effective in improving BFD because the resin cannot flow substantially due to high viscosity and therefore the fabric is incompletely and sparsely impregnated. Applying moderate levels of solid adhesives from the melt is effective in increasing fabric stiffness and thus improving BFD, but the $V_{50}$ drops substantially and comfort is sacrificed. The phrase "from the melt" means the adhesive can be an originally solid film melted into the fabric surface by laminating or could be extrusion of a thin solvent-free layer of hot polymer from a slit die onto the fabric surface. In both cases, the polymer can get stuck on the outside of the fabric surface and cannot penetrate enough to be effective.

Applying low levels of solid adhesives or elastomers from solution is not effective because the thin adhesive junctions between bundles in the fabric are brittle and cannot heal after mechanical deformation during normal wear.

BRIEF SUMMARY OF THE INVENTION

This invention is directed to a process of making a fabric that includes providing a woven fabric made from a yarn with a tenacity of at least 10 gpd, applying to the fabric a viscous polymer in a 5 to 40 wt % solution with a solvent, wherein the polymer has a $T_g$ in the range of about −40 to about 0° C. and evaporating the solvent such that the polymer only partially penetrates the fabric such that the polymer is located with the fiber yarns before the polymer solidifies.

DETAILED DESCRIPTION OF THE INVENTION

This invention provides for the fabrication of ballistic garments from fabrics having substantially lower basis weights that significantly decrease the extent of blunt trauma currently achieved with conventional 100% woven fabric systems. Adequate $V_{50}$ and flexibility are also retained. The fabric can be woven from yarn having a tenacity of at least 10 grams per denier (gpd).

The viscous polymers for applying to the fabric are provided in a solution of 5 to 40 wt % based on the total weight of the polymer and solvent. The polymer has a $T_g$ in the range of −40 to about 0° C. and a zero shear melt viscosity of about $2\times10^6$ to about $10^{13}$ poise when measured at 20° C. The viscous polymer coating eventually partly resides between the bundles of the fibers where it can more effectively increase bundle-sliding friction at relatively low weight percentages of the polymer coating material. Bundles are multiple filaments or fibers (i.e., yarns) that make up the fabrics. Without being held to any theory, it is believed that although some of the polymer can penetrate the bundles, an effective amount can be maintained outside the bundles to achieve the desired effect. This is accomplished through the combination of a relatively high viscosity and the relatively rapid rate of evaporation of the solvent. This combination can be controlled to obtain a range of penetration. As such, the polymer can be located primarily on one side of the fabric but it can be located partially under the bundles or can flow partly through the fabric to the bundles on the uncoated side.

The strain-responsive viscous liquid polymers with appropriate weight average molecular weight (Mw) and glass transition temperature ($T_g$) are described in co-pending patent application, internally designated as KB-4800, also assigned to DuPont. This application of adhesive is critical to maximizing the amount of ballistic fiber at a given basis weight in order to retain high $V_{50}$. Moreover, this is achieved with improved BFD.

In this invention, the viscosity of the polymer solution and the rapid solvent evaporation limit the flow of the polymer solution into the multifilament bundles. Thus, the polymer eventually partly resides in thicker tougher layers between bundles because solvent evaporation fixes it in place. Furthermore, fabrics treated with these liquid (but highly viscous) adhesives are self-healing, unlike those impregnated with solid elastomers. The use of such viscous liquid adhesives having these attributes has not been considered in the prior art.

Finish oils are often used in making woven fabrics and tend to diminish this bundle sliding friction because of reduced adhesion of these weak adhesives and thus increases BFD (i.e., makes it worse). Using spray coating from moderately viscous solutions, along with proper removal of finish oils also gives the same incomplete bundle impregnation leading to good BFD. The prior art has not dealt with finish removal to modify interfaces in such low adhesive ballistic systems.

Although not an exhaustive list, other coating methods can be used, such as doctor blades, transfer coating, and solution extrusion coating from a slit die. These are done at lower added polymer levels than have been demonstrated in the prior art.

It has been surprisingly found that scouring, that is, the finish removal by relatively short-duration aqueous rinsing of the fabric provides sufficient efficacy of strain-responsive polymer to yield low BFD values. Typically, scouring refers to finish removal by aqueous rinsing to remove a large percentage of the finish oil, however in this case scouring refers to removal of a relatively smaller amount of finish oil. Rinsing the fabric is performed in room temperature aqueous baths and includes four dipping cycles in aqueous baths with excess water removed by squeezing between cycles. The fabric was finally then heated at about 70° C. for about 45 seconds under mild vacuum to dry the fabric by gently removing the water. Post-coating heating for drying after the polymer coating application employs similar mild time and temperature cycle. In the case of a polyaramid such as Kevlar®, the moderate drying times and temperatures are required to retain high $V_{50}$, because it becomes dehydrated even by mild temperatures (around 100° C.) and there can be some permanent loss of $V_{50}$.

Generally, the zero shear viscosities of the subject adhesives as provided herein are too high at room temperature to be measured by standard techniques. Capillary viscometry data were obtained at temperatures between 50° C. and 100° C. and at shear rates from 1 s-1 to 1000 s-1. Zero shear rate viscosities were then estimated by extrapolating from these temperatures to 20° C. and zero shear rate.

Advantages are further exemplified in the non-limiting examples below

EXAMPLES

In the following examples, an ethylene/methyl acrylate (38/62 w/w %) copolymer having a high MW of about 100,000 g/mol and a zero shear rate melt viscosity of $1\times10^7$ Poise (Po) at 20° C. measured by capillary viscometry is referred to as "E/MA-high". It is available as Vamac® VCD 6200 from DuPont. An ethylene/methyl acrylate (38/62 w/w %) with a glass transition temperature of −32° C. having a medium MW of about 40,000 g/mol and a zero shear rate melt viscosity of $6\times10^6$ Po at 20° C. and is referred to as "E/MA-medium". It is an experimental grade made by DuPont. High Mw poly(hexyl methacrylate) with Mw at 400,000 g/mol is referred to as "PHM" and is available from Scientific Polymer Products Company (Ontario, N.Y.).

For all examples (other than those in Ex 3-5) the BFD value for each of the two shots taken was given without averaging.

Example 1

Polyaramid fabric panels having a plain weave construction of 840 denier poly(para-phenylene terephthalamide) yarn available from DuPont under the trademark KEVLAR® woven at 26×26 ends per inch (10.2×10.2 ends per centimeter) and having a nominal face weight of 5.8 oz/sq yd. were scoured and dried. Scoured fabric panels were coated using a rubber doctor blade with E/MA-high having a glass transition temperature of −32° C., from a 15% solution in toluene with a solution viscosity of 144 centiPoise at 20° C. The final coating was 3.4 wt % of the coated fabric weight after evaporating toluene under conditions of the invention. A ballistic pack, prepared from 21 layers of coated panels, having a basis weight of about 0.87 psf was placed against a clay bed and tested with a 0.357 magnum projectile under NIJ level II test conditions. $V_{50}$ was measured to be 1583 ft/s. Back face deformation values were 32 mm and 33 mm at impact velocities of 1440 ft/s and 1440 ft/s, respectively.

Comparative Example A and B

Comparative Example A was a ballistic pack, prepared from 21 layers of uncoated polyaramid fabric having a plain weave construction of 840 denier yarn and having a nominal face weight having a basis weight of about 0.87 psf was placed against a clay bed and tested against 0.357 magnum projectile under NIJ level II test conditions. $V_{50}$ was measured to be 1577 feet per second (ft/s). Back face deformation values were 40 mm and 38 mm at impact velocities of 1460 ft/s and 1443 ft/s, respectively.

Comparative Example B was another ballistic pack having a basis weight of about 0.84 psf was prepared from 21 layers of uncoated polyaramid fabric having a plain weave construction of 840 denier yarn and having a nominal face weight of 5.8 oz/sq. yd. Pack was placed against a clay bed and tested against 0.357 magnum projectile under NIJ level II conditions. Ballistic penetration resistance was measured to be 1627 ft/s. Back face deformation values were 44 mm and 41 mm at impact velocity of 1450 ft/s and 1452 ft/s, respectively.

Example 1 shows good BFD and $V_{50}$ with 3.4% added E/MA-high viscous liquid polymer coated on one side from a viscous polymer solution, while uncoated fabric layers in Comparative Example A and B show higher BFD values. The BFD for Comparative Example A was slightly better than Comparative Example B, due to the higher basis weight of the former.

Example 2

Polyaramid fabric panels having a plain weave construction of 840 denier as in Example 1 above and having a nominal face weight of 5.8 oz/sq yd were scoured and dried. Scoured fabric panels were coated, using a spray technique, with E/MA-med having a glass transition temperature of −32° C., from a 15% solution in toluene. Final coating was 5.1% of the coated fabric weight after evaporating toluene under conditions of invention. A ballistic test pack, prepared from 20 layers of coated panels, having a basis weight of about 0.84 psf was placed against a clay bed and tested against 0.357 magnum projectile under NIJ level II test conditions. Ballistic penetration resistance was measured to be 1560 ft/s. Back face deformation values were 32 mm and 35 mm at impact velocities of 1427 ft/s and 1453 ft/s, respectively. This example shows good BFD and $V_{50}$ with 5.1% added E/MA-med viscous liquid polymer spray coated on one side from a moderately viscous polymer solution. Rapid drying during spraying especially limits the flow of the polymer solution into the multifilament bundle leading to higher friction and better BFD.

Examples 3, 4, 5, and Comparative Example C

Twenty-two layers of 840d Kevlar® polyaramid fabric panels, having a plain weave construction as described above were variously treated and tested for BFD and $V_{50}$, as shown below. Twenty-two layers of the fabric that was not treated with polymer was used for Comparative Example C. BFD is an average taken from five 0.357 magnum shots at 1430±30 ft/s, except for Comparative Example C where it is an average of ten shots).

TABLE 1

| Example/Application | Polymer | wt % on fabric | Solution wt % | $V_{50}$ (ft/s) | BFD (mm) |
|---|---|---|---|---|---|
| Example 3/one side | E/MA-high | 2.4 | 13% toluene | 1484 | 34.4 |
| Example 4/spray | E/MA-high | 2.1 | 6.2 MEK | 1485 | 36.5 |
| Example 5/one side coat | PHM | 3.3 | 13% toluene | 1538 | 35.5* |
| Comparative Example C | n.a. | n.a | n.a. | 1507** | 41** |

*One penetration occurred at 1430 ft/s.
n.a. in the table above means not applicable.

Examples 3, 4, and 5 are further demonstrations for optimal low coating weight fractions and methods leading to good BFD and relatively good $V_{50}$ and include two different viscous polymer additives (E/MA-high and PHM). BFD for uncoated Comparative Example C is worse and $V_{50}$ for all of these items are essentially the same.

Comparative Example D

Unscoured polyaramid fabric panels had a plain weave construction of 840 denier with a nominal face weight of 5.8 oz/sq. yd. fabric panels were coated with E/MA-high having a glass transition temperature of −32° C., from a 13% solution in toluene with a solution viscosity of 76 cPoise at 20° C. Final coating was measured to be 2.3 wt % of the coated fabric weight after evaporating the toluene under conditions of invention. A ballistic pack, prepared from 21 layers of coated panels, having a basis weight of about 0.84 psf was placed against a clay bed and tested using a 0.357 magnum projectile under NIJ level II test conditions. Ballistic penetration resistance was measured to be 1571 ft/s. Back face deformation values were 43 mm and 40 mm at impact velocity of 1461 ft/s and 1459 ft/s, respectively. It is believed that the absence of scouring resulted in the finish oils remaining on the fabric and thereby interfering with adhesion of the polymer solution.

It is believed that Comparative Example C exhibited poor BFD because finish oils interfere with and reduce adhesion leading to lower bundle friction and worse BFD, while Example 1 has the oil removed before coating and had good BFD. The coating solution used and coating method were the same for both of these examples.

Example 6

In this example, a 63-inch wide by 20 yard long sample of a square weave fabric comprising 840d Kevlar® yarn as above and having a basis weight of 5.8 oz/yd$^2$ was spliced between two lengths of a nylon fabric of similar length. The nylon fabric served as leader material for subsequent processing. The fabric had been previously subjected to a proprietary scouring process by the weaver to bring the residual finish level to a specification of less than 0.2 wt. %.

The fabric was mounted on an unwind positioned at the infeed of a continuous coater. A 62 inch wide roll of 2 mil thick silicone coated poly(ethyleneterephthalate) (PET) release liner was positioned on a second unwind at the infeed of the coater. Both the fabric and the release film were then processed through the coater at 4.5 yards/min. In particular, the release film first passed into a reverse roll coating station at which a 15 wt. % solution of ethylene/methyl acrylate (E/MA-high) in methyl ethyl ketone (MEK) was coated onto the silicone treated surface of the release film to a width of 60 inches. The E/MA-high/MEK solution coated release film was then laminated to the fabric at a second station such that the coated side of the release film came in contact with one surface of the fabric. A set of two idler rolls were positioned such that the coated release film/fabric laminate made an "S" wrap wherein the contact pressure between the release film and fabric was increased so that the E/MA-high/MEK coating was substantially transferred to the fabric and partially impregnated the fabric. Prior to processing the Kevlar® fabric, adjustments were made at the reverse roll coating station such that the system delivered a coating weight (dry basis) of 0.28 oz/yd2 to the release film such that the subsequently coated and dried Kevlar® fabric comprised 4.6 wt. % E/MA-high.

The release film/fabric laminate then continuously passed through a convective, hot air dryer to remove the MEK solvent. The laminate was oriented such that the fabric was exposed to the impinging hot air flow so as to enhance the drying rate. The dryer settings were such that the laminate emerged from the dryer essentially free of MEK and having achieved a temperature of 73° C. The laminate then continuously passed through a set of squeeze rolls to transfer any residual E/MA-high that remained on the release film to the fabric. The film/fabric laminate was then collected on a cardboard core on a standard fabric winder. The release film and the nylon fabric on either end of the Kevlar® fabric was then removed and discarded.

The Kevlar® fabric was then cut into nominal 15 inch by 15 inch plies which were then used to construct four 20-ply ballistic panels for testing. The panels were tested at a ballistic range following NIJ Standard 0101.04 Type II using 357 Magnum JSP bullets. The four panels had an average $V_{50}$ of 1546 ft/sec and an average BFDeformation of 37 mm.

What is claimed is:

1. A process of making a fabric comprising:

(a) providing a woven fabric comprising a yarn with a tenacity of at least 10 gpd, (b) applying to the fabric a viscous liquid polymer in a 5 to 40 wt % solution with a solvent, wherein the polymer has a $T_g$ in the range of minus 40° C. to about 0° C. and a zero shear melt viscosity of about $2\times10^6$ to about $10^{13}$ poise when measured at 20° C. and (c) evaporating the solvent such that the polymer only partially penetrates the fabric such that it resides between fiber bundles.

2. The process of claim 1, wherein the polymer present after step (c) is less than about 9 wt % by weight of the fabric.

3. The process of claim 1, wherein the fabric has a yarn denier of about 200 to 4500.

4. The process of claim 1, including before step (b), scouring steps of rinsing the fabric with water between 20- 100° C. and drying the fabric such that the fabric is maintained at a temperature of less than 100° C.

5. The process of claim 4, wherein the fabric is maintained at a temperature of less than 80° C. in drying the fabric.

6. The process of claim 1, wherein the polymer is selected from the group consisting of medium molecular weight ethylene/methyl acrylate of about 40,000 g/mol, high molecular weight ethylene/methyl acrylate of about 100,000 q/mol, and high molecular weight poly(hexyl methacrylate) of about 400,000 g/mol.

7. The process of claim 1, wherein the polymer is from a solution and the solution viscosity is greater than 0.01 Poise at 20° C. and with a solvent having a boiling point of less than about 150° C.

8. The process of claim 1, wherein the polymer is applied from a solution and the solvent is evaporated below 100° C.

9. The process of claim 1, wherein the fabric comprises polyaramid yarn.

10. The process of claim 1, wherein the viscous polymer is applied by knife or doctor blade coating directly onto the fabric.

11. The process of claim 1, wherein the viscous polymer is applied by roll coating directly onto the fabric.

12. The process of claim 1, wherein the viscous polymer is applied by coating a film, then transfer coating the fabric from the coated film.

13. The process of claim 1, wherein the viscous polymer is applied by a spray.

14. The process of claim 1 wherein the yarn comprises fibers selected from the group consisting of aromatic polyamide, polyolefin, polybenzoxazole, polybenzothiazole, poly{2,6-diimidazo[4,5-b4', 5'-e]pyridinylene-1,4(2,5-dihydroxy) phenylene}, polyareneazoles, polypyridazoles, polypyridobisimidazole and mixtures thereof.

* * * * *